US011017755B2

(12) United States Patent
Mills

(10) Patent No.: US 11,017,755 B2
(45) Date of Patent: May 25, 2021

(54) PICKUP WITH VARIABLE COIL WINDINGS FOR STRING INSTRUMENTS

(71) Applicant: Christopher B. Mills, Wayne, PA (US)

(72) Inventor: Christopher B. Mills, Wayne, PA (US)

( * ) Notice: Subject to any disclaimer, the term of this patent is extended or adjusted under 35 U.S.C. 154(b) by 0 days.

(21) Appl. No.: 16/880,328

(22) Filed: May 21, 2020

(65) Prior Publication Data

US 2020/0372889 A1 Nov. 26, 2020

Related U.S. Application Data

(60) Provisional application No. 62/850,603, filed on May 21, 2019.

(51) Int. Cl.
*G10H 3/18* (2006.01)

(52) U.S. Cl.
CPC ..... *G10H 3/181* (2013.01); *G10H 3/183* (2013.01)

(58) Field of Classification Search
CPC ..... G10H 3/181; G10H 3/183
USPC ..... 84/726–728
See application file for complete search history.

(56) References Cited

U.S. PATENT DOCUMENTS 3,711,619 A 1/1973 Jones et al.
4,222,301 A * 9/1980 Valdez ..... G10H 3/182 84/728
4,501,185 A * 2/1985 Blucher ..... G10H 3/182 84/728
8,309,836 B1 * 11/2012 Bolger ..... G10H 3/143 84/723
8,319,088 B1 * 11/2012 Harari ..... G10H 3/181 84/727
9,257,112 B2 * 2/2016 Mills ..... G10H 3/181
9,704,464 B1 * 7/2017 Petschulat ..... G10H 3/186
10,163,431 B2 * 12/2018 Mills ..... G10H 3/181
2010/0101399 A1 * 4/2010 Calvet ..... G10H 3/181 84/726
2018/0108335 A1 * 4/2018 Cudney ..... G10H 3/143

OTHER PUBLICATIONS

S. K. Guitar Specialties, "Factors affecting how a pickup sounds", http://www.skguitar.com/SKGS/sk/pickup_factors.html, downloaded Apr. 5, 2019, 3 pages.
Lemme, H. E. W, "The Secrets of Electric Guitar Pickups", Electronic Musician, Dec. 1986, 66-72.
Wikipedia, "Set theory", https://en.wikipedia.org/wiki/Set_theory, downloaded Oct. 12, 2020, 12 pages.
Wikipedia, "Subset", https://en.wikipedia.org/wiki/Subset, downloaded Oct. 12, 2020.

* cited by examiner

*Primary Examiner* — Jeffrey Donels
(74) *Attorney, Agent, or Firm* — Saul Ewing Arnstein & Lehr LLP; Brian R. Landry

(57) ABSTRACT

A pickup with variable coil windings for string instruments is described herein. In one aspect, the pickup including a coil including a first subsection wound around a first subset of pole pieces of a plurality of pole pieces; and a second subsection wound around a set of pole pieces of the plurality of pole pieces, the set of pole pieces selected from the group of: the plurality of pole pieces in its entirety and a second subset of pole pieces different than the first subset of pole pieces.

17 Claims, 7 Drawing Sheets

500

100

200

300

400

500

600

700

PICKUP WITH VARIABLE COIL WINDINGS FOR STRING INSTRUMENTS

CROSS-REFERENCE TO RELATED APPLICATION

This application claims priority under 35 U.S.C. § 119(e) of U.S. Provisional Patent Application Ser. No. 62/850,603, filed May 21, 2019. The entire content of this application is hereby incorporated by reference herein.

FIELD OF INVENTION

The disclosure relates generally to pickups for musical instruments, and, more specifically, to a pickup for a musical instrument having a coil variably wound around pole pieces.

BACKGROUND OF THE INVENTION

Many string instruments have pickups that convert vibrations of a string instrument to an electrical signal where it may be amplified and reproduced through loudspeakers or provided to a recording device. Pickups are commonly available in two forms: magnetic pickups and piezoelectric pickups. Magnetic pickups are typically included within electric guitars, electric basses, electric banjos and similar devices and typically consist of one or more magnetic poles wrapped with a coil of several thousand turns of copper wire, which are typically mounted on the body of an instrument. The one or more magnetic pole pieces create a magnetic field that is disturbed by the motion of the vibrating strings, changing the magnetic flux and inducing an electric current through the coil. The pickup is typically communicatively coupled with an amplifier and/or recording equipment.

SUMMARY

A pickup with variable coil windings for string instruments is described herein. In one aspect, the pickup including a coil including a first subsection wound around a first subset of pole pieces of a plurality of pole pieces; and a second subsection wound around a set of pole pieces of the plurality of pole pieces, the set of pole pieces selected from the group of: the plurality of pole pieces in its entirety and a second subset of pole pieces different than the first subset of pole pieces.

This aspect can include a variety of embodiments. In one embodiment, the pickup can further include a bobbin having a recess. In some cases, the coil can be disposed within the recess. In some cases, the bobbin can further include a plurality of hollow posts.

In another embodiment, the plurality of pole pieces includes at least four pole pieces.

In another embodiment, the plurality of pole pieces includes at least six pole pieces.

In another embodiment, a distance between a first pole piece of the plurality of pole pieces and a second pole piece of the plurality of pole pieces is greater than a distance between the second pole piece and a third pole piece of the plurality of pole pieces.

In another embodiment, a distance between each pole piece of the plurality of pole pieces is similar.

In another embodiment, each of the plurality of pole pieces are magnets.

In another embodiment, each of the plurality of pole pieces includes ferromagnetic materials lying within a magnetic field.

In another embodiment, the coil is wound around the first subset of pole pieces a first number of windings, and wound around the second subset of pole pieces a second number of windings. In some cases, the second number of windings is greater than the first number of windings.

In another embodiment, the pickup can be a part of a string instrument, where the string instrument further includes a plurality of strings, where each string of the plurality of strings passes over a respective pole piece of the plurality of pole pieces. In some cases, the string instrument is one of an electric guitar, an electric bass guitar, and an electric banjo.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Without being bound by theory, Applicant asserts that conventional approaches to varying the tonal qualities of a pickup are limited as such approaches only rely upon varying a small number of parameters within the pickup. Applicant identified that by winding coil around pole pieces of a pickup non-uniformly, the tonal qualities of the pickup can be further altered and enhanced. Pickups having variable coil windings around pole pieces are described in greater detail within the following disclosure.

Figure 1:
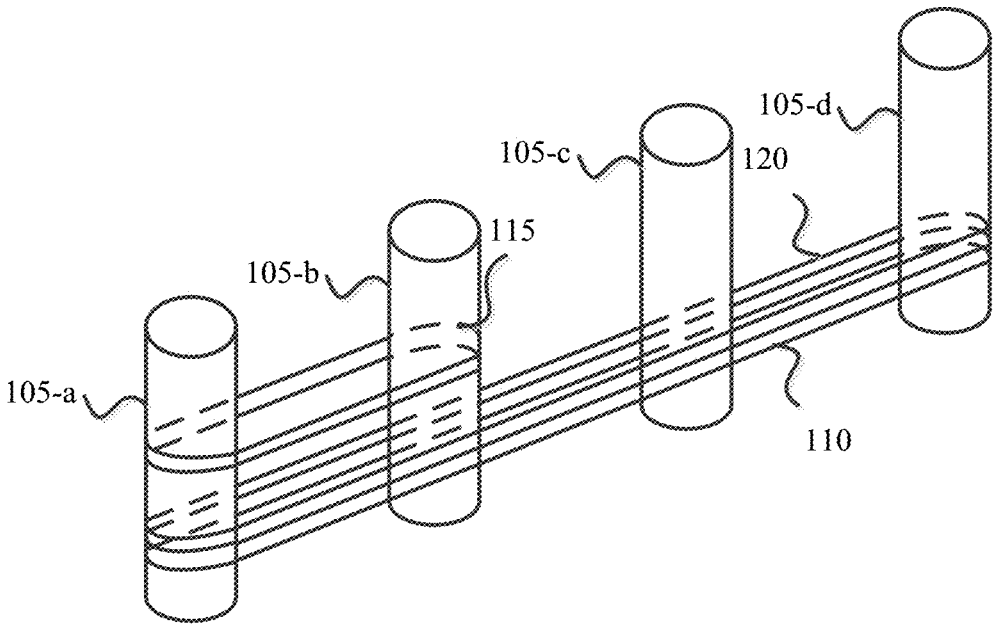
FIGS. 1-3 are configurations for a pickup according to embodiments of the disclosure.

Referring to FIG. 1, one embodiment of a pickup 100 for a string instrument is shown. The pickup 100 includes pole pieces 105 (105-*a*-105-*d*) and a coil 110. In various embodiments, the pickup 100 can also include a bobbin (e.g., bobbin 500 of FIG. 5). These elements and others will be described below in greater detail.

As illustrated in FIG. 1, the pickup 100 includes a plurality of pole pieces (e.g., pole pieces 105-*a*-105-*d*). In one or more embodiments, the pole pieces 105 are (but need not be) aligned with the strings of a string instrument and serve as a magnetic conductor for a corresponding string. Various spring spacing conventions exists and spacing rulers are available, for example, from Stewart-McDonald of Athens, Ohio.

In one embodiment, the pole pieces are non-uniformly wrapped with a coil, for example, coil 110 of FIG. 1. For example, at least one pole piece of the pickup 100 can be wrapped by a subset of the total number of coil windings of the pickup. FIG. 1 illustrates a pickup 100 where a first pole piece 105-*a* and a second pole piece 105-*b* are wrapped with a first set of windings 115 as well as a second set of windings 120. However, third pole piece 105-*c* and fourth pole piece 105-*d* are wrapped only by the second set of windings 120, thereby creating a disparity between the number of windings around the first and second pole pieces 105-*a* and 105-*b*, respectively, and the number of windings around the third and fourth pole pieces 105-*c* and 105-*d*, respectively.

Figure 2:
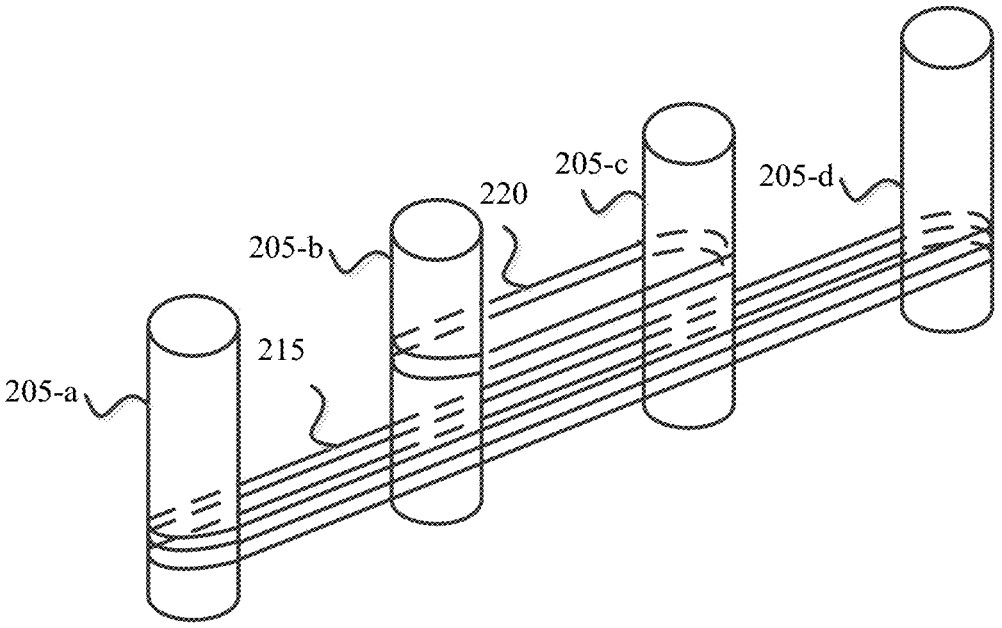

FIG. 2 illustrates a pickup 200 where a second pole piece 205-*b* and a third pole piece 205-*c* are wrapped with a first set of windings 215 as well as a second set of windings 220. However, first pole piece 205-*a* and fourth pole piece 205-*d* are wrapped only by the first set of windings 215, thereby creating a disparity between the number of windings around the second and third pole pieces 205-*b* and 205-*c*, and the number of windings around the first and fourth pole pieces 205-*a* and 205-*d*.

Figure 3:
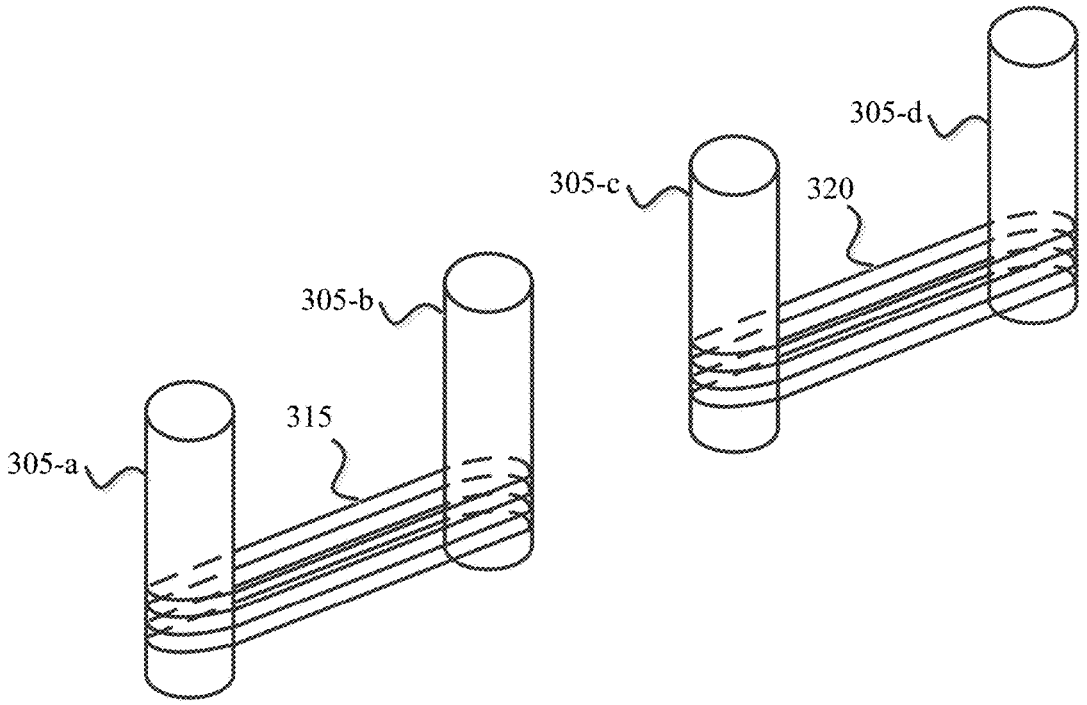

FIG. 3 illustrates a pickup 300 where a first pole piece 305-*a* and a second pole piece 305-*b* are wrapped with a first set of windings 315, and third pole piece 305-*c* and fourth pole piece 305-*d* are wrapped by a second set of windings 320. In this illustration, the first set of windings 315 and the second set of windings 320 may be separated from one another. Thus, the number of windings, and material used, for each winding set may be independent (e.g., in parallel) from one another. In another embodiment, the first set of windings 315 and the second set of windings 320 may be connected (e.g., in series) by a single length of wire.

In some embodiments, the pole pieces are disposed along a non-linear path such that a first pole piece interacts with a corresponding string of a string instrument differently than a second pole piece interacts with a corresponding string of the string instrument. For example, the pole pieces may interact with corresponding strings at different distances from a common reference point. Alternatively, the pole pieces are disposed along a linear path.

With further reference to FIG. 1, the pickup 100 can include four pole pieces 105-*a*-105-*d*. However, in other embodiments, the pickup 100 may include less than or more than four pole pieces. For example, the pickup 100 may include 3, 5, 6, 12, or 24 pole pieces. Further, the pickup 100 may include a pole piece for each string of a corresponding instrument.

In various embodiments, the distances between adjacent pole pieces 105 are based on the distances of corresponding strings of an instrument. The pole pieces 105 can be configured to be centered under corresponding strings, defining the spacing or distance between pole pieces 105.

In one embodiment, the distance between a first adjacent pair of pole pieces 105 differs from the distance between a second adjacent pair of pole pieces 105. For example, the pickup 400 in FIG. 4 can include pole pieces 405-1-405-*d*. The distance between pole piece 405-*a* and pole piece 405-*b* can differ from the distance between pole piece 405-*b* and 405-*c*. In other embodiments, the distances between each adjacent pair of pole pieces 405 is the same. Further, distances between each adjacent pair of pole pieces can differ. Further yet, at least one distance between adjacent pole pieces 405 can differ from the others.

In various embodiments, each pole piece includes a magnetic material. In other embodiments, each pole piece includes a ferromagnetic material lying within a magnetic field, e.g., induced by a magnet otherwise coupled with the pole pieces. In one embodiment, each pole piece includes steel coupled with one or more magnets. For example, each pole piece may be a steel bolt or rod that is coupled with a magnet sitting below the pole pieces.

The orientation of the pole pieces 105 determines the direction of the magnetic field within the pickup. For example, the pole pieces may be configured to create a north or south magnetic charge. The direction of the magnetic charge may also be referred to as the polarity of the pickup.

With continued reference to FIG. 1, a wire coil 110 is disposed around pole pieces 105. The wire coil 110 can include several thousand turns of wire, e.g., fine wire such as 42 or 43 AWG. The wire can be coated with an insulator such as enamel, polymer, polyurethane, and the like. The wire can have a copper conductor or use other ductile metals such as aluminum, cadmium, niobium (also known as "columbium"), copper, gold, iron, nickel, platinum, silver, tantalum, titanium, zinc, zirconium, and the like, and alloys thereof. In one embodiment, the wire coil 110 may be coated after winding (e.g., through dip coating in a material such as wax, lacquer, epoxy, and the like) to reduce feedback.

Figure 4:
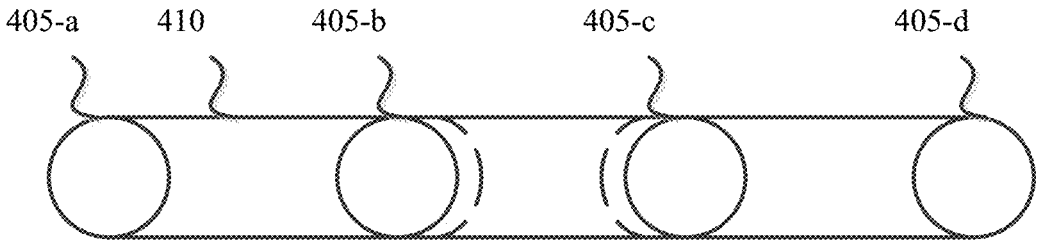
FIG. 4 is a top view of a pickup according to an embodiment of the disclosure.

As is illustrated in the embodiment of FIG. 4, the wire coil 410 can have a profile corresponding to the path of pole pieces 405.

A first end of the wire coil may be coupled to a positive connection and the second end of the wire coil may be coupled to a negative connection of an amplifier and/or recording device such that electrical signals corresponding to disruptions in the magnetic field of the pickup may be communicated to the amplifier and/or recording device. The wire coil may be referred to as having a direction of wind. The direction of wind corresponds to the path that electricity flows through the wire coil and is defined by which ends of the wire coil are coupled to positive and negative (or ground) connections. The coil can be connected to a phone connector (e.g., a ¼" phone jack, also known as a TS connector) for coupling to an amplifier.

Figure 5:
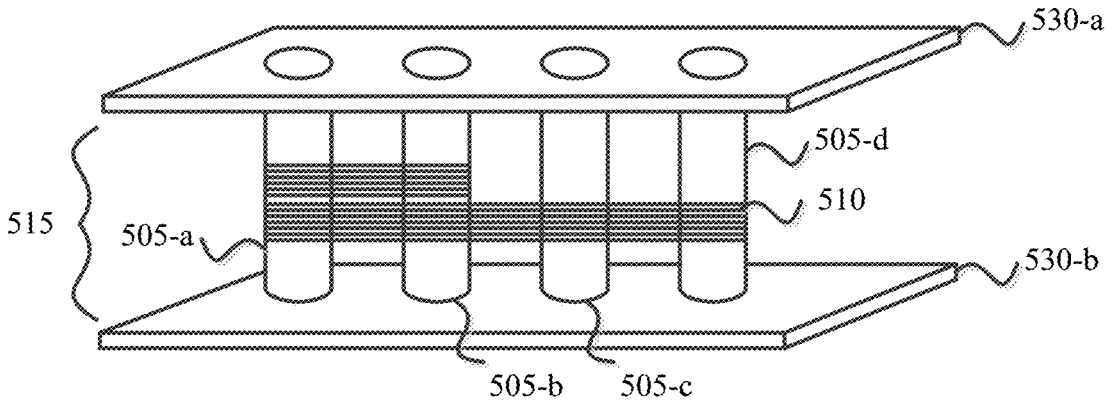
FIG. 5 is a perspective view of a bobbin according to an embodiment of the disclosure.

FIG. 5 illustrates an embodiment of a bobbin 500. In the illustrated embodiment, bobbin 500 includes a recess 515 and top and bottom support members (530-*a* and 530-*b*).

The recess 515 can be defined by the top and bottom support members (530-*a* and 530-*b*). In one embodiment, the bobbin 500 further includes a plurality of pole posts 505 (e.g., 505-*a*-505-*d*) and the recess 515 is further defined by the plurality of posts 505. Further, a wire coil 510 can be disposed within the recess 515 of bobbin 500.

In various embodiments, one or more pole pieces may be housed within corresponding pole posts, such as pole pieces 105 as described in FIG. 1. In one embodiment, bobbin 500 includes an equal number of pole posts 505 as pole pieces 105 of the pickup 100. In other embodiments, bobbin 500 includes less pole posts 505 than pole pieces 105 of pickup 100. In such embodiments, the bobbin 500 may include one more holes within support members 530-*a* and 530-*b* configured to receive a corresponding pole piece 105.

In other embodiments, the top and bottom support members (530-*a* and 530-*b*) include a plurality of holes configured to receive the pole posts 505. The pole posts 505 are positioned within corresponding holes of the first and second support members (530-*a* and 530-*b*) and couple the first and second support members (530-*a* and 530-*b*) with each other. In such embodiments, the bobbin 500 may or may not include pole posts 505 (e.g., pole posts configured to receive pole pieces).

In one embodiment, the bobbin 500 may be one continuous piece of plastic formed using plastic molding techniques, 3D printing, or a similar process. In other embodiments, the support member 530-*a* and support member 530-*b* and/or pole posts 505 are separately formed and then coupled together to form the bobbin 500 (e.g., via adhesive, ultrasound welding, and the like).

As is illustrated in FIG. 5, the profile of the bobbin 500 can be rectangular in shape. However, in other embodiments, the profile of bobbin 500 may be substantially circular, or elliptical in shape. Without being bound by theory, Applicant believes that any bobbin 500 can have any profile that facilitates mounting within a string instrument. Further, in various embodiments, the profile of bobbin 500 may include one or more curved or angle portions.

In one embodiment, the wire coil 510 may be formed separately from the bobbin 500 and then placed over the posts of the bobbin 500. For example, a wire coil 510 may be formed around a mandrel and then placed over the posts of the bobbin.

The wire coil 510 may be formed such that it has a profile corresponding to that of the pole posts 505 before it is placed around the pole posts 505. In other embodiments, the wire coil may be formed around the pole posts 505 of a bobbin and then shaped such that its profile is similar to the non-linear path of the pole posts 505. In one embodiment, pole post 505-*a* is configured to be moveable, such that the distance between pole posts 505-*a* and 505-*b* may be reduced. In another embodiment, pole post 505-*d* is configured to be movable, such the distance between pole posts 505-*c* and 505-*d* may be reduced. In yet another embodiment, both pole posts 505-*c* and 505-*d* may be configured to be moveable. For example, tension applied to a pole post 505 may be reduced, allowing the pole post 505 to be moved. In another embodiment, a moveable pole post may configured to move in such that it is at least partially deformed, allowing the wire coil to be shaped. A movable pole post may include at least one of a different material and shape from a non-movable pole post.

Experimental Analysis

A comparison of audio frequency generated by (a) a conventional electric guitar pickup and (b) one deploying a variable-wound pickup according to an embodiment of the invention reveals qualitative differences in a sound wave of identical frequency generated by each pickup.

Methodology

Two pickups were constructed using identical plastic parts, same gauge wire, same number of turns of wire, and same type of magnet. The only physical difference was deployment of a "double-winding" scheme that is an embodiment of this disclosure. The "stock" pickup did not exploit the double-winding scheme, while the "ZuZu" pickup did employ the double-winding scheme.

Test conditions in which each generated a signal tone were identical: same guitar, same strings, same lead, same amplifier, same microphone, and same recording setup. In each of the two test instances the guitar's open "A" string, tuned to 110 Hz, was plucked.

Results

The signal analysis was performed by AUDACITY® audio analysis software. MICROSOFT® EXCEL® rendered a graphic interpretation of the results and plotted "frequency" along the x-axis and "amplitude," in dB, along the y-axis. The resulting graphical peaks represent audio content at particular harmonic frequencies. Thus, the taller the peak, the relatively louder the frequency.

Figure 6:
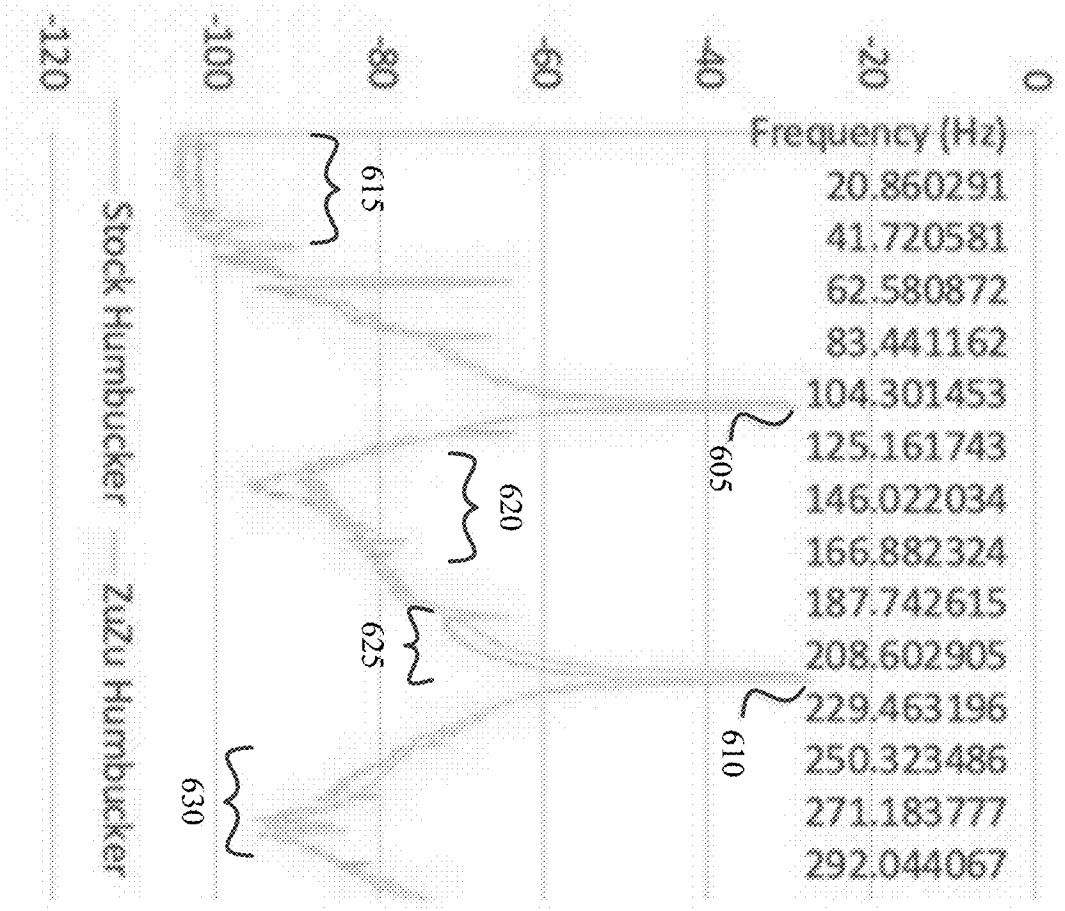
FIGS. 6 and 7 depict signal analysis graphs for the signal generated by each of a conventional humbucker pickup and a variably wound pickup according to embodiments of the disclosure.

FIG. 6 depicts a signal analysis graph 600 for the signal generated by each pickup when the open "A" guitar string was plucked. As can be seen, the stock and ZuZu pickups include virtually identical amplitude and the A-string's tuned frequency of 110 Hz (e.g., at point 605). Similarly, the stock and ZuZu pickups include virtually identical amplitude at the A-string's second harmonic of 220 Hz (e.g., at point 610). However, differences can be seen at other frequency registers between the two pickups, for example, significant differences occur at roughly the 20 Hz frequency region (point 615), the 130 Hz frequency (point 620), the 200 Hz frequency (point 625), and the 260 Hz frequency region (point 630).

Figure 7:
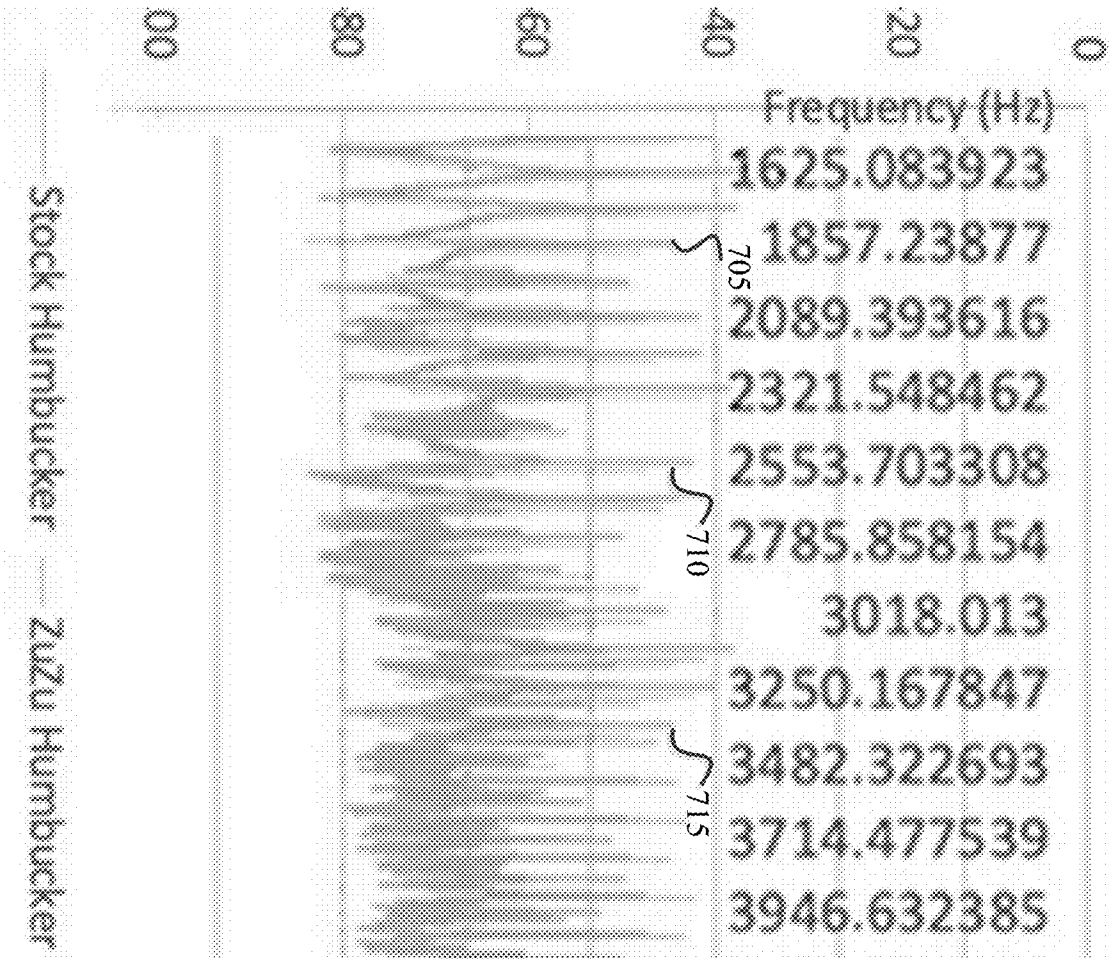

FIG. 7 depicts another signal analysis graph 700 for the signal generated by each pickup when the open "A" guitar string was plucked. The graph depicted in FIG. 7, though, depicts frequency registers in higher range (e.g., between approximately 165 Hz to 3970 Hz). This content, similar to the frequency range depicted in FIG. 6, is within the range of human hearing.

Note that the amplitude of the audible content generated by the ZuZu pickup is greater at some frequencies and lesser at others. The amplitude can vary from that of corresponding signals generated by the stock pickup by as much as 7 dB (e.g., at points 705, 710, 715, and the like): a difference discernible by the human ear.

Discussion

To a listener, these differences in frequency amplitude across the two pickups can present as qualitatively different sounds.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A pickup for a string instrument, the pickup comprising:

a coil consisting of:

a first subsection wound around a proper subset of pole pieces of a plurality of pole pieces; and a second subsection wound around the plurality of pole pieces in its entirety.

2. The pickup of claim 1, further comprising a bobbin having a recess.

3. The pickup of claim 2, wherein the coil is disposed within the recess.

4. The pickup of claim 2, wherein the bobbin further comprises a plurality of hollow posts.

5. The pickup of claim 1, wherein the plurality of pole pieces comprises at least four pole pieces.

6. The pickup of claim 1, wherein the plurality of pole pieces comprises at least six pole pieces.

7. The pickup of claim 1, wherein a distance between a first pole piece of the plurality of pole pieces and a second pole piece of the plurality of pole pieces is greater than a distance between the second pole piece and a third pole piece of the plurality of pole pieces.

8. The pickup up of claim 1, wherein a distance between each pole piece of the plurality of pole pieces is similar.

9. The pickup of claim 1, wherein each of the plurality of pole pieces are magnets.

10. The pickup of claim 1, wherein each of the plurality of pole pieces comprises ferromagnetic materials lying within a magnetic field.

11. The pickup of claim 1, wherein the coil is:

wound around the first subset of pole pieces a first number of windings, and wound around the second subset of pole pieces a second number of windings.

12. The pickup of claim 11, wherein the second number of windings is greater than the first number of windings.

13. A string instrument comprising:

the pickup of claim 1; and a plurality of strings, wherein each string of the plurality of strings passes over a respective pole piece of the plurality of pole pieces.

14. The string instrument of claim 13, wherein the string instrument is one of an electric guitar, an electric bass guitar, and an electric banjo.

15. The pickup of claim 1, wherein the proper subset of pole pieces includes an outermost pole piece.

16. The pickup of claim 1, wherein the proper subset of pole pieces includes an outermost pole piece.

17. A pickup for a string instrument, the pickup comprising:

a coil comprising:

a first subsection wound around a proper subset of pole pieces of a plurality of pole pieces; and a second subsection wound around the plurality of pole pieces in its entirety;

wherein the first subset of pole pieces has a cumulative number of windings of the coil greater than that of a set difference of the plurality of poles and the proper subset.

* * * * *